United States Patent [19]

Parker

[11] Patent Number: 4,710,056

[45] Date of Patent: Dec. 1, 1987

[54] METHOD AND APPARATUS FOR RESTORING A BEACH

[76] Inventor: William L. Parker, 220 21st St. S.W., Naples, Fla. 33964

[21] Appl. No.: 22,578

[22] Filed: Mar. 10, 1987

Related U.S. Application Data

[63] Continuation of Ser. No. 823,739, Jan. 29, 1986, abandoned.

[51] Int. Cl.[4] ..... E02B 3/04; E02B 3/06

[52] U.S. Cl. ..... 405/15; 405/32; 405/34

[58] Field of Search ..... 405/15, 21, 23–25, 405/28–30, 32–35; 256/12.5, 23

[56] References Cited

U.S. PATENT DOCUMENTS

| | | | |
|---|---|---|---|
| 388,338 | 8/1888 | Bright | 405/35 X |
| 449,185 | 3/1891 | Solomon | 405/32 |
| 1,716,509 | 6/1929 | Smith | 405/32 |
| 1,721,894 | 7/1929 | Abbe | 256/23 |
| 1,844,484 | 2/1932 | Smith | 405/32 |
| 1,906,442 | 5/1933 | Barrus | 256/12.5 X |
| 1,969,123 | 8/1934 | Doble | 405/32 X |
| 2,097,342 | 10/1937 | Rehfeld | 405/34 |
| 2,135,337 | 11/1938 | Herbest | 405/32 |
| 2,341,515 | 2/1944 | Rehfeld | 405/32 |
| 3,564,853 | 2/1971 | Csiszar | 405/32 |

FOREIGN PATENT DOCUMENTS

| | | | |
|---|---|---|---|
| 576376 | 10/1977 | U.S.S.R. | 256/23 |

*Primary Examiner*—Nancy J. Stodola

*Attorney, Agent, or Firm*—Merrill N. Johnson

[57] ABSTRACT

A method and apparatus for restoring a beach by raising the level of the beach between the high tide line and the low tide line of the beach in which an elongated rectangular net of nylon cord is suspended from a temporary supporting structure generally perpendicular to the high tide line of the beach and extending from the high tide line to at least the low tide line, said net having a uniform mesh sized to prohibit passage through said net of the larger rocks, coral and shells present on the sea floor and having a weighted bottom edge resting upon the sea floor and a top edge suspended above the high tide level of the sea, wherein said net remains suspended between the high tide line and the low tide line for a period of at least twelve hours, and then said net and its supporting structure are removed from the beach.

9 Claims, 4 Drawing Figures

SEA
LOW TIDE LINE
HIGH TIDE LINE
BEACH
HIGH TIDE SEA LEVEL

METHOD AND APPARATUS FOR RESTORING A BEACH

This is a continuation of co-pending application Ser. No. 823,739, now abandoned, filed on Jan. 29, 1986.

BACKGROUND AND SUMMARY OF THE INVENTION

My invention pertains to a method and apparatus for the restoration and/or buildup of a stretch of beach which has been or is in danger of being eroded by such natural forces as winds, tides, waves and water currents.

Especially along shorelines where residential, recreational or other structures have been erected close to the shoreline, any substantial change in or erosion of a pre-existing shoreline can seriously affect the use, enjoyment and value of the man-made facilities along or near the shoreline.

While the need for restoration of eroded beaches is increasing as more and more beach areas are being bordered with homes, condominiums and public and private recreational facilities, the options available for beach restoration have been restricted by recent federal, state and local regulations designed to preserve natural resources and prevent ecological damage.

My method and apparatus for beach restoration does no ecological damage but instead is totally pollution-free. It preserves all natural resources and requires no permanent or long term man-made structures either along the shoreline or in the water. No foreign gravel or fill is hauled in by trucks. No sea bottom deposits are discharged onto the beach from barges lying offshore and sucking up existing sea bottom deposits.

My method of beach restoration requires only the erection of temporary non-polluting structures along the stretch of beach for a short period of time. When the beach has been restored, these structures are cleanly and completely removed.

Briefly, my invention requires the erection and temporary maintenance of a plurality of individual nets located generally perpendicular to the shoreline and running from the high tide line to the low tide line. The nets are suspended from a line maintained generally parallel to the sea floor and somewhat above the surface of the sea at high tide. The bottom of the net is weighted so that the bottom of the net will lie upon the sea floor.

Preferably the net is made of nylon cord and the mesh of the net is chosen so that the larger rocks, coral fragments, sea shells and shell fragments lying along the sea bottom at that particular beach area will not pass through the net. Each net lying at 90° to the shoreline and running from the high tide line to the low tide line is maintained in that position for 24 hours or more depending upon the existing tide, wind and wave conditions. Exposure of the net to these natural forces will cause a gradual buildup of shells, coral, rocks and sand around the lower portion of the net.

This buildup of the natural elements of the sea bottom will gradually bury the lower portion of the net to a depth of as much as two feet or more at the low tide end of the net and to a somewhat lesser height along the rest of the net. Then when the buildup has reached its maximum height, the net and its supporting structures can be taken down and the net dragged out of the built up ridge by a winch or other means located on the beach.

By the use of a plurality of parallel nets positioned several yards apart along a beach, a considerable stretch of beach can be built up and restored in a relatively short period of time and at a small fraction of the cost of any alternative method of restoration. Equally important, the process uses only those elements already present along the shoreline and thus the process restores the beach to its pre-existing natural state.

A successful demonstration of my invention was recently conducted at Pelican Bay located on the Gulf of Mexico just north of the City of Naples in Collier County, Fla.

BRIEF DESCRIPTION OF THE DRAWINGS

The operation and apparatus used in my beach restoration process will be apparent from the following description of a preferred and the drawings in which.

DETAILED DESCRIPTION OF THE PREFERRED EMBODIMENT

Figures 1, 2, 3, 4:
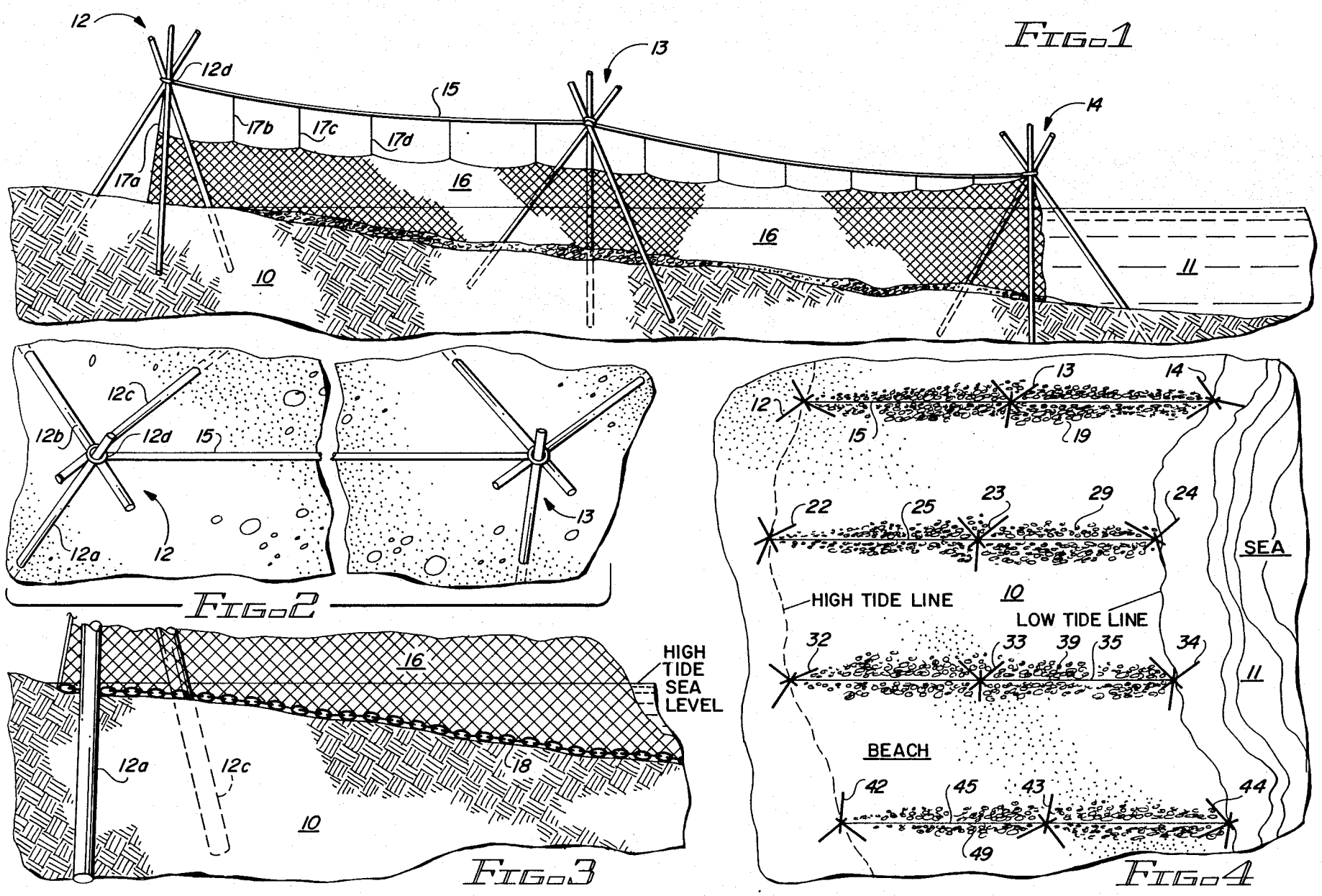
FIG. 1 is a side perspective view of a preferred embodiment of apparatus for practicing my beach restoration process.
FIG. 2 is a plan view partially broken away showing a portion of the apparatus illustrated in FIG. 1 in greater detail.
FIG. 3 is a side view partially broken away of the same portion of the apparatus as shown in FIG. 2.
FIG. 4 a plan view showing the arrangement of four generally parallel nets similar to the net shown in FIGS. 1–3 along a stretch of beach being restored in accordance with my beach restoration process.

FIG. 1 shows a preferred form of the unique apparatus used in carrying out my beach restoration invention on a beach 10, with the sea 11 shown at high tide level. Three tripods 12, 13 and 14 are embedded in the beach or sea floor 10 and spaced about 10 feet apart along a line generally perpendicular to the high tide line of the beach.

Tripod 12 is located on the beach's high tide line, tripod 14 is located just beyond the low tide line, and tripod 13 is located midway between the other two. Thus the distance between high and low tides is twenty feet. If that distance were much more than twenty five feet, an additional tripod should be used.

As best shown in FIGS. 2 and 3, each tripod consists of three steel rods approximately ten feet long and ¾th of an inch in diameter. Each rod, for example, rods 12*a*, 12*b* and 12*c* forming tripod 12, is pushed or driven into the beach about two to three feet spaced so their lower ends form the corners of an equilateral triangle and their upper ends meet like the poles of an Indian teepee. The upper ends of the three rods are then lashed together preferably with nylon cord 12*d* so that the point of joinder of rods 12*a*, 12*b* and 12*c* is about seven or eight feet above the high water line of the beach. The resulting tripod makes an excellent temporary supporting structure for the net used to restore the beach.

A one half inch diameter nylon rope 15 is secured to each of tripods 12, 13 and 14 and net 16 is suspended from rope 15 by a plurality of nylon lines 17*a*, 17*b*, 17*c*, 17*d* etc. Preferably vertical lines 17*a*, etc. are sized to keep the upper edge of net 16 about two feet above the surface of the sea at high tide.

Net 16 is in the shape of an elongated rectangle with its length somewhat longer than the distance between the high and low tide lines of the beach. The width of the net should be sufficient that there is some slack between the upper edge of the net and its lower edge which rests on the sea floor. The entire lower edge of net 16 is weighted with a length of chain 18 sewn to said lower edge. I have found that steel chain made of ⅜th of an inch diameter links will keep the lower edge of the net on the sea bottom despite considerable wave and wind action and/or the retention of considerable shells, rocks and coral deposited in and along the lower edge of the net.

Net 16 is preferably made of nylon cord and the mesh of the net (that is, the size of the openings formed by intersecting cords) is carefully chosen so that the larger rocks, pieces of coral, shells, shell fragments and other components making up the sea floor will not pass through the mesh of the net. It is the retention of these components which normally move along the sea floor as the result of tides, currents, wind and waves which begins the build up of sea floor components along the extent of the net in accordance with my invention.

When the net 16 is left in place for at least 12 hours and preferably 24 hours or more, a buildup of sea floor components including sand will occur burying the lower portion of net 16 to a depth of as much as two feet or more. For the beaches in and around Naples, Collier County, Fla. I have found net 16 is preferably #21 commercial nylon fish netting with a stretch mesh of two inches (that is, the distance between the diagonally stretched corners of an opening in the net measures two inches).

The rocks, coral, shells and sand will thus form a ridge along the sea floor running from the high tide line to the low tide line. When this ridge has reached the desired height, net 16 is taken down from its supporting structure and line 15 and tripods 12, 13 and 14 are removed. Then net 16 can be dragged out of the ridge of rocks, coral, shell and sand which cover the lower portion of the net by a winch or other means located on the beach.

I have found that when a plurality of nets are suspended along a stretch of beach as shown in FIG. 4 that the level of that entire stretch of beach can be quickly raised by a foot or more. Preferably the nets are spaced about eight to ten feet apart. FIG. 4 illustrates the use of multiple nets and shows four parallel nets (not shown) suspended respectively beneath lines 15, 25, 35 and 45. Tripods 12, 13 and 14 support line 15: tripods 22, 23 and 24 support line 25; tripods 32, 33 and 34 support line 35; and tripods 42, 43 and 44 support line 45.

FIG. 4 also shows ridges 19, 29, 39 and 49 made up of rocks, coral, shells and sand formed along the sea floor surrounding the lower portion of the nets (not shown) beneath lines 15, 25, 35 and 45. When the nets and their respective supporting structures have been removed from the beach, the subsequent action of the tides, currents and waves will tend to fill in the valleys between ridges 19, 29, 39 and 49 with sand and other components of the sea floor so as to effect restoration of the beach to a higher level than existed prior to the use of my beach restoration method.

Of course, further raising of the level of the beach can be accomplished by repeating the steps just described at a later date.

While having shown and described a preferred embodiment of my method and apparatus, it will be apparent that changes and modifications may be made particularly in the apparatus used without departing from the scope and spirit of my invention. Accordingly, the scope of my invention is to be limited only by the appended claims.

I claim:

1. A method of restoring a sandy beach by raising the level of the beach between the high tide line and at least the low tide line of the beach comprising suspending by a temporary supporting structure an elongated net generally perpendicular to the high tide line of the beach and extending from the high tide line to at least the low tide line, said net being made of flexible material and having a uniform mesh sized to prohibit passage through said net of the larger rocks, coral and shells present on the sea floor, said net having a weighted bottom edge, resting upon the sea floor and a top edge suspended above the high tide level of the sea, leaving said net suspended between the high tide line and at least the low tide line for a period of not less than twelve hours to cause the gradual buildup of rocks, coral, shells and sand along the lower portion of the net, and then removing said net and its supporting structure from the beach.

2. A method of restoring a sandy beach by raising the level of the beach in the area between the high tide line and at least the low tide line of the beach comprising suspending from temporary supporting structures a plurality of similar elongated nets spaced along the beach generally perpendicular to the high tide line of the beach and each net extending from the high tide line to at least the low tide line, said nets each being made of flexible material and having a uniform mesh sized to prohibit passage through said net of the larger rocks, coral and shells present on the sea floor, said nets each having a weighted bottom edge resting upon the sea floor and a top edge suspended above the high tide level of the sea, leaving said nets suspended between the high tide line and at least the low tide line for a period of not less than twelve hours to cause the gradual buildup of rocks, coral, shells and sand along the lower portion of each net, removing all of said nets and their supporting structures from the beach, and then permitting the action of the tides, currents and waves to fill in the areas spaced between the built-up areas with sand and other components of the sea floor so as to raise the level of the beach.

3. The method according to claim 2 wherein said nets are spaced approximately ten feet apart along the beach.

4. The method according to claim 2 wherein a plurality of parallel nets are positioned several yards apart along the beach.

5. Apparatus for use in restoring a sandy beach by raising the level of the beach between the high tide line and at least the low tide line of the beach comprising an elongated net made of flexible cord and having a uniform mesh sized to prohibit passage through said net of the larger rocks, coral and shells present on the sea floor of the beach, means for suspending said elongated net generally perpendicular to the high tide line of the beach so that said net extends from the high tide line to at least the low tide line, wherein the means for suspending the net includes a plurality of spaced apart tripods and an elongated line secured to each of the tripods and from which the net is suspended, said net having a weighted bottom edge resting upon the sea floor and a top edge maintained above the high tide level of the sea by said suspending means, said apparatus being designed to cause the gradual buildup of rocks, coral, shells and sand along the lower portion of the net.

6. Apparatus according to claim 5 wherein the net is made of nylon cord.

7. Apparatus according to claim 5 wherein the weight along the bottom edge of the net consists of a length of ⅜ths inch diameter metal chain.

8. Apparatus according to claim 5 wherein each tripod consists of three metal rods having their lower ends spaced apart and embedded into the sea floor and their upper ends lashed together.

9. Apparatus for use in restoring a sandy beach by raising the level of the beach between the high tide line and at least the low tide line of the beach comprising a plurality of elongated rectangular nets each made of flexible cord and having a uniform mesh sized to prohibit passage through said net of the larger rocks, coral and shells present on the sea floor of the beach, a plurality of tripods for suspending each elongated net generally perpendicular to the high tide line of the beach so that said net extends from the high tide line to at least the low tide line, each net having a weighted bottom edge resting upon the sea floor and a top edge maintained above the high tide level of the sea, and said nets being spaced approximately ten feet apart along the beach to cause the gradual buildup of rocks, coral, shells and sand along the lower portion of each net.

* * * * *